US008519282B2

(12) United States Patent
Ohshima et al.

(10) Patent No.: US 8,519,282 B2
(45) Date of Patent: Aug. 27, 2013

(54) JOYSTICK DEVICE

(75) Inventors: Yuji Ohshima, Kanagawa (JP); Masatoshi Kotake, Kanagawa (JP)

(73) Assignee: Sony Corporation, Tokyo (JP)

( * ) Notice: Subject to any disclaimer, the term of this patent is extended or adjusted under 35 U.S.C. 154(b) by 242 days.

(21) Appl. No.: 13/071,920

(22) Filed: Mar. 25, 2011

(65) Prior Publication Data

US 2011/0240454 A1 Oct. 6, 2011

(30) Foreign Application Priority Data

Mar. 30, 2010 (JP) ..... P2010-077446

(51) Int. Cl.
*H01H 19/00* (2006.01)
*H01H 21/00* (2006.01)

(52) U.S. Cl.
USPC ..... 200/6 A

(58) Field of Classification Search
USPC ..... 200/6 A, 6 R, 4, 37, 19.18–19.19, 200/547, 529, 553, 252, 321, 336, 339, 17 R, 200/50.34, 50.35, 32, 9
See application file for complete search history.

(56) References Cited

U.S. PATENT DOCUMENTS 4,590,339 A * 5/1986 Scott-Jackson et al. ..... 200/6 A
7,109,430 B2 * 9/2006 Horton et al. ..... 200/296

FOREIGN PATENT DOCUMENTS

JP 2004 310299 11/2004
JP 2006 128620 5/2006

* cited by examiner

*Primary Examiner* — Edwin A. Leon
*Assistant Examiner* — Anthony R. Jimenez
(74) *Attorney, Agent, or Firm* — Frommer Lawrence & Haug LLP; William S. Frommer

(57) ABSTRACT

Disclosed herein is a joystick device, including: a control shaft having one end to which a control knob is attached and the other end to which a turning portion of a turning device is connected; a holder supporting the control shaft shiftably in an axial direction of the control shaft; a case body supporting the holder turnably around a turning shaft portion extending in a direction perpendicular to the axial direction of the control shaft; an elastic member biasing the control shaft in the axial direction; and an axial force adjusting portion capable of adjusting a pressing force by varying a biasing force of the elastic member, the pressing force being adapted to shift the control shaft in the axial direction.

4 Claims, 8 Drawing Sheets

JOYSTICK DEVICE

BACKGROUND OF THE INVENTION

1. Field of the Invention

The present invention relates generally to joystick devices used in control equipment of various types. Specifically, the invention relates to a joystick device capable of adjusting the operational force (weight) such as an axial pressing force and a back and forth turning force and stroke (shift) of a control knob.

2. Description of the Related Art

There is a traditional joystick device of this type as described in e.g. Japanese Patent Laid-Open No. 2006-128620 (Patent Document 1). In Patent Document 1, a stick lever unit is described which can be used in the operation of a gaming machine or the like to generate a control signal. The stick lever unit described in Patent Document 1 (hereinafter called "the first existing example") is characterized by the following. The stick lever unit includes a securing member, a first variable resistor attached to the securing member, and a first turning member. The first variable resistor is provided with a turning body having a through-hole as a turning operating portion which varies a resistance value. The first turning member has a stick lever and is pivotally supported by the securing member to turn-control the first variable resistor. The first turning member is provided with a turning shaft which is inserted into the through-hole of the first variable resistor and is coupled to the turning body.

Another traditional joystick device is described in e.g. Japanese Patent Laid-Open No. 2004-310299 (Patent Document 2). In Patent Document 2, the joystick device is described which is provided with a plurality of volume adjustment functions and a switching operation function. The joystick device described in Patent Document 2 (hereinafter called "the second existing example") includes a joystick lever, a control knob portion, a variable resistor, a variable resistor with a switch, and a control tubular body. The joystick lever is pivotally supported by a base shaft installed in control equipment. The control knob portion is provided at the distal end of the joystick lever. The variable resistor is installed in the control equipment to perform volume adjustment through the turning of the joystick lever. The variable resistor with a switch is installed in the control knob to perform volume adjustment through the shaft-turning operation of a control shaft and switching operation through axial pressing operation. The control tubular body has a turning operating portion and a pressing operating portion and is attached to the control shaft of the variable resistor with a switch in the control knob portion.

SUMMARY OF THE INVENTION

However, in the case of the first existing example described above, the axial length of the stick lever is fixed, i.e., cannot be adjusted. In other words, the axial length of the stick lever is a value determined by dimensional control. If the dimensional control has variations, the stick levers are provided for the use of users while having such variations. If the length of the stick lever is changed depending on user's taste, therefore, it is needed to replace the lever per se. This poses a problem of not only needing extensive remodeling work but also being uneconomical.

In the case of the second existing example described above, the variable resistor is configured to be mounted inside the control knob portion. A harness is passed into the inside of the joystick lever and soldered at its end to the variable resistor.

During maintenance or part replacement, it may be necessary to remove the control knob portion from the joystick lever. In such a case, the harness soldered to the variable resistance needs to be removed in each case. There is a problem with poor workability. Further, since the variable resistor is mounted inside the control knob portion, the weight of the control knob is large. For example, when a professional-use camera is operated, the adjustment torque of an IRIS (aperture) value may be set at a low level. Consequently, in such a case there is a problem in that the weight balance of the control knob portion is lost so that the joystick lever is moved under the own weight of the control knob portion.

The problems to be solved are as below. In the first existing example, the length of the stick lever is fixed; therefore, a structure is not provided in which the pressing force of the stick lever can be changed. Because of this, in order to adjust the magnitude of the pressing force or length of the stick lever in response to a user request, it is necessary to replace a spring, a lever and the like, i.e., to perform extensive remodeling work. In the second existing example, the variable resistor is mounted inside the control knob portion; therefore, the weight of the control knob portion is large. Thus, if the operation torque is set at a low level, the weight balance is lost so that the joystick lever is moved under the own weight of the control knob portion.

According to an embodiment of the present invention, there is provided a joystick device including: a control shaft having one end to which a control knob is attached and the other end to which a turning portion of a turning device is connected; a holder; a case body; an elastic member; and an axial force adjusting portion. The holder supports the control shaft shiftably in the axial direction. The case body supports the holder turnably around a turning shaft portion extending in a direction perpendicular to the axial direction of the control shaft. The elastic member biases the control shaft in the axial direction. The axial force adjusting portion can adjust a pressing force by varying a biasing force of the elastic member, the pressing force being adapted to shift the control shaft in the axial direction.

According to the embodiment of the present invention, the pressing force of the control shaft (stick lever) can be adjusted simply and rapidly as well as the control (stroke and weight) according to user's preference can be set easily.

DETAILED DESCRIPTION OF THE PREFERRED EMBODIMENTS

The biasing force of an elastic member is varied by an axial force adjusting portion. This can easily and rapidly adjust the pressing force adapted to axially shift a control shaft. With this, a joystick device that can set the pressing force of the control shaft at user's desired magnitude can be achieved with a simple configuration.

Figure 11:
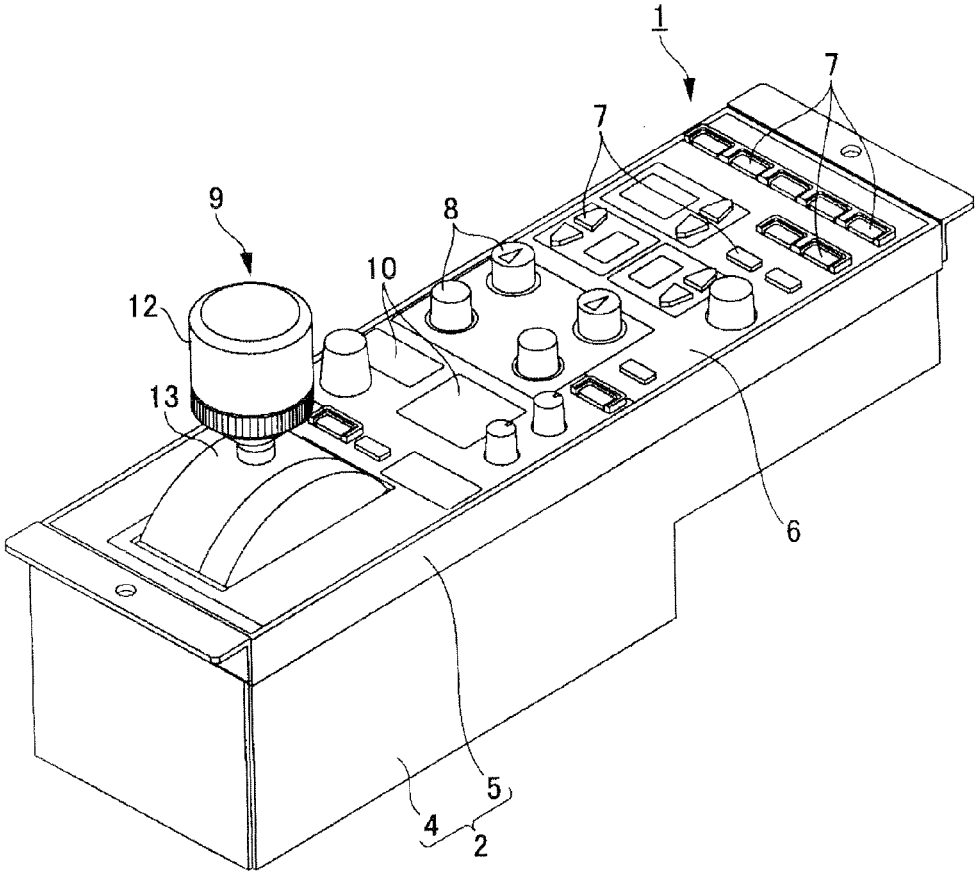
FIG. 11 is an external perspective view of a remote controlling device showing electronic equipment as one example which uses the joystick device according to an embodiment of the present invention.

FIG. 11 illustrates electronic equipment as one example which uses a joystick device according to an embodiment of the present invention. This electronic equipment is a remote controlling device that remote-controls a television camera. This remote controlling device 1 is generally mounted to a control table of the television camera and is used in this state to remote-control the television camera.

The remote controlling device 1 includes a housing 2 composed of a rectangular container; a controller, not illustrated, housed in the housing 2; a large number of pressing-type switch devices 7 used to input operating information operating this controller; a plurality of dial devices 8; and a joystick device 9. The housing 2 includes a container body 4 opening at an upper surface; a lid body 5 closing an upper-surface opening portion of the container body 4; and an operation-display plate 6 mounted to the upper surface of the lid body 5. Although not illustrated in the figure, the opening portion of the container body 4 is provided with positioning guides projecting toward the lid body 5. The guides allow the lid body 4 to align with the container body 4 so that the lid body 5 covered will not be misaligned.

Although not illustrated in the figure, the lid body 5 has a lower-opening recessed portion opening at a lower surface and a relatively shallow upper-opening recessed portion provided at an upper surface. A circuit board is housed in the lower-opening recessed portion. The circuit board is secured to the lid body 5 via a bracket. The operation display plate 6 is attached to the upper-opening recessed portion of the lid body 5. The operation display plate 6 is integrally secured to the lid body 5 by means of an adhesion section such as an adhesive. The circuit board is composed of a plate-like member having such a size as to cover almost the whole of the lower-opening recessed portion of the lid body 5. In addition, the circuit board is provided on one surface (or both surfaces) with a circuit pattern formed in a predetermined shape.

The circuit board is used to provide on the lid body 5 a large number of the pressing-type switch devices 7, a plurality of the dial devices 8, the joystick device 9 and a plurality of information display portions 10. Although not illustrated in the figure, the pressing switch 7 is composed of a pressing switch, a light source, a keytop member, a seat member, and adhesion rubber. The pressing switch is a general on-off switch, in which an input portion is operatively pressed the first time to open (or close) a circuit and pressed the second time to close (or open) the circuit and the opening and closing operation of the circuit is repeated the third time onward. A large number of the pressing switches mentioned above are mounted on the front surface of the circuit board at given positions. A light-emitting diode (LED) as a light source emitting illumination light is mounted to both sides of each pressing switch.

Each of the dial devices 8 includes a switch main body secured to the circuit board, and a dial portion secured to a turning shaft of the switch main body. The turning shaft of the switch main body passes through the upper surface of the lid body 5 and the operation display body 6. The dial portion is secured to a portion, of the turning shaft, projecting upward from the upper surface of the housing 2. The information display portions 10 are composed of e.g. a liquid crystal display. A display surface of the information display portions 10 passes through the upper surface of the lid body 5 and the operation display plate 6 and is exposed to the upper surface of the housing 2.

The joystick device 9 is a device that performs on/off operation on a preview switch of a television camera and adjustment on an iris (aperture) value of the television camera. The joystick device 9 includes an axial shifting mechanism axially shifting a control lever (a stick lever) at a given distance, and a turning mechanism turning a control shaft in back and forth directions at a given angle. The control shaft is pressed to be axially shifted at a given distance to turn on the preview switch. On the other hand, its pressing force is released to return the control shaft to an initial position to turn off the preview switch. The control shaft is turned in one of the back and forth directions to turn a variable resistor for iris value adjustment, increasing the iris value (brightness). The control shaft is turned in the other direction to turn the variable resistor to decrease the iris value (dimness).

The joystick device 9 is configured as illustrated in FIGS. 1 to 4. Specifically, the joystick device 9 includes a control lever 11, a control knob 12, a holder 13, a case body 14, a coil spring 15, an axial force adjusting portion 16, a stroke adjusting portion 17, and a turning force adjusting portion 18.

Referring to FIGS. 1 to 4, the control lever 11 includes an elongate rod-like control shaft 21 circular in cross-section; and a cylindrical outer tube 23 through which an axial hole 22 passes, the axial hole 22 being adapted to receive the control shaft 21 inserted therethrough. The outer tube 23 is set to a length shorter than the axial length of the control shaft 21. The control shaft 21 passes through bushes 24, 24 fitted to both ends of the axial hole 22. Both the ends of the control shaft 21 project outwardly. In this way, the control shaft 21 is turnably supported by the outer tube 23 via the two bushes 24, 24. Snap rings 25 are attached to corresponding portions, of the control shaft 21, projecting from both the ends of the outer tube 23. The two snap rings 25, 25 prevent the control shaft 21 from being axially shifted. In addition, the control shaft 21 and the outer tube 23 are configured to be integrally shifted in the axial direction.

The outer tube 23 has a large-diameter portion 23*a* provided on one side in the axial direction and a small-diameter portion 23*b* provided on the other side. A flange portion 23*c* extending toward the radial outside is provided on the end face side of the large-diameter portion 23*a* of the outer tube 23. The large-diameter portion 23*a* is provided on the end face side extending from the flange portion 23*c* with a threaded portion 23*d* having an external thread. A first support bracket described later is secured to the threaded portion 23*d*. For example, steel, stainless steel or the like is suitable for use as material for the control shaft 21 and the outer tube 23.

Figure 1:
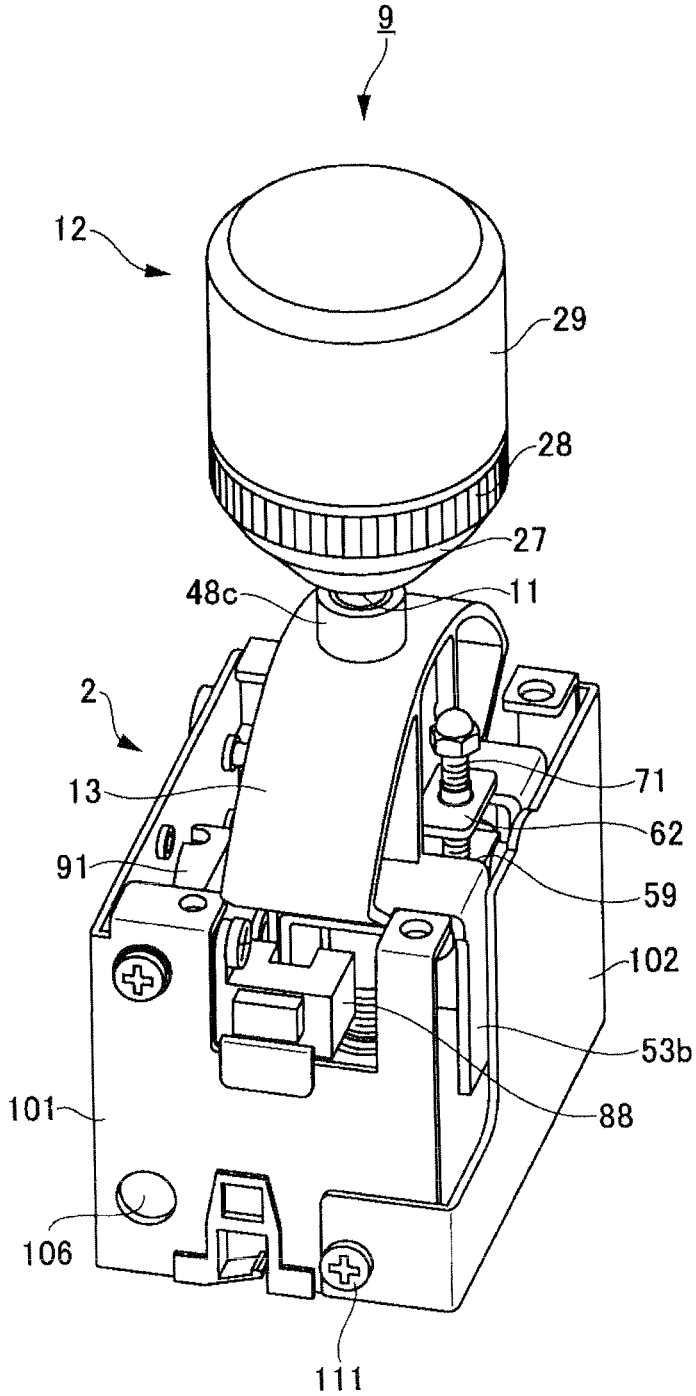
FIG. 1 is a perspective view illustrating a joystick device according to an embodiment of the present invention.
Figure 2:
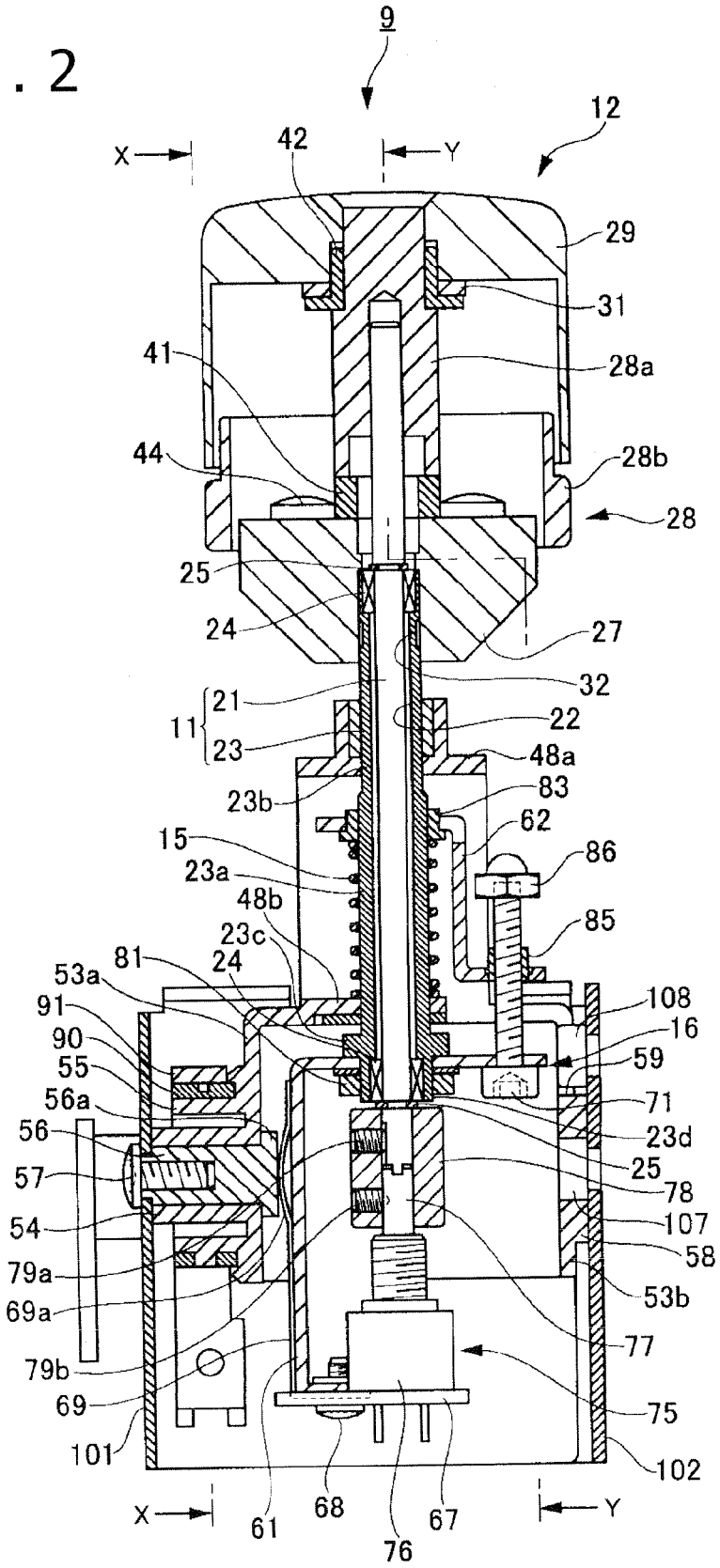
FIG. 2 is an explanatory longitudinal cross-sectional view of the joystick device of FIG. 1, taken along the central portion thereof.
Figure 4:
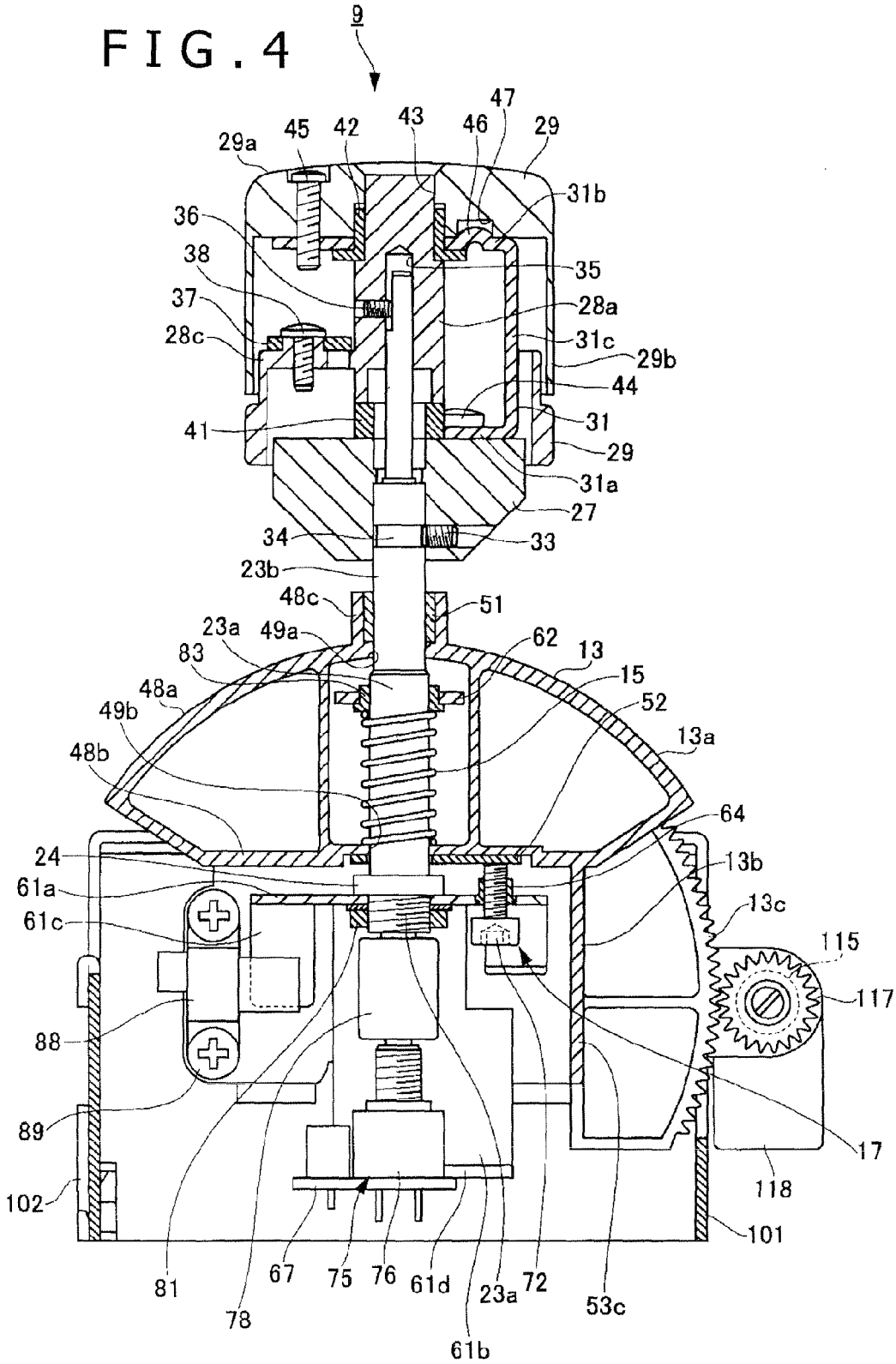
FIG. 4 is an explanatory cross-sectional view of the joystick device of FIG. 1, taken along line Y-Y in FIG. 2.

The control knob 12 is attached to the axial one side (the side opposite the flange portion 23*c* of the outer tube 23) of the control lever 11. As illustrated in FIGS. 2 and 4, the control knob 12 includes a securing shaft body 27, a turning tubular body 28, a gripping tubular body 29 and a connecting bracket 31. The securing shaft body 27 is composed of a disklike member having an axial hole 32 passing through its central portion. The outer tube 23 of the control lever 11 is fitted into the axial hole 32. In this case, the control shaft 21 passes through the axial hole 32 and largely projects outwardly from the end face of the securing shaft body 27. The securing shaft body 27 is provided with a screw hole extending in the radial direction. A fixation screw 33 is threadedly engaged with the screw hole. The fixation screw 33 can contact a circumferentially continuous annular groove 34 provided in the small-diameter portion 23*b* of the outer tube 23. The fixation screw 33 is tightened to secure the securing shaft body 27 to the outer tube 23.

The turning tubular body 28 and the connecting bracket 31 are disposed on the securing shaft body 27. In addition, the gripping tubular body 29 is disposed so as to cover the turning tubular body 28 and the connecting bracket 31. The turning tubular body 28 includes a columnar central shaft portion 28*a*, a cylindrical portion 28*b* provided concentrically with the central shaft portion 28*a*, and an arm portion 28*c* connecting the cylindrical portion 28*b* with the central shaft portion 28*a*. The central shaft portion 28*a* of the turning tubular body 28 is composed of a circular shaft body having a diameter greater than that of the control shaft 21. An axial hole 35 extending to an axial midway portion is provided at the axial center portion of the central shaft portion 28*a*. One end of the control shaft 21 is fitted into the axial hole 35. A fixation screw 36 threadedly engaged with a radially extending screw hole provided in the central axial portion 28*a* is tightened to secure the turning tubular body 28 to the control shaft 21. Thus, the turning tubular body 28 and the control shaft 21 are united in the turning direction.

The inside diameter of the cylindrical portion 28*b* of the turning tubular body 28 is greater than the outside diameter of the securing shaft body 27. The turning tubular body 28 is shaped such that the securing shaft body 27 partially enter the hole of the cylindrical portion 28*b*. The arm portion 28*c* is shaped to project radially outwardly from a portion of the outer circumferential surface of the central shaft portion 28*a*. The cylindrical portion 28*b* merges with the radially outside end portion of the arm portion 28*c*. A stopper member 37 is attached to the arm portion 28*c* by means of an attachment screw 38 so as to limit the turning amount of the turning tubular body 28. A torque rubber 41 is secured to an end face, of the central shaft portion 28*a*, on the securing shaft body 27 side by means of a securing section such as a double-stick tape, an adhesive or the like. The torque rubber 41 is adapted to increase the friction force occurring when the turning tubular body 28 is turned.

The torque rubber 41 generates an appropriate frictional resistance force when the turning tubular body 28 is operatively turned, which applies a certain level of operational feeling to an operator, thereby providing a sense of ease during operation. For example, sponge rubber is suitable for use as material for the torque rubber 41. However, the torque rubber 41 is not limited to the sponge rubber but can use a rubber-like elastic body such as silicon rubber or the like. A sleeve 42 is turnably fitted to an upper end portion of the central shaft portion 28*a* of the turning tubular body 28. The sleeve 42 is held by the gripping tubular body 29.

The gripping tubular body 29 includes a disk-like upper surface portion 29*a* and a cylindrical skirt portion 29*b* provided to integrally merge with the one surface side of the upper surface portion 29*a*. A through-hole 43 is provided at the central portion of the upper surface portion 29*a* of the gripping tubular body 29. The sleeve 42 is fitted into the through-hole 43. The outside diameter of the skirt portion 29*b* is made almost the same as the maximum outside diameter of the cylindrical portion 28*b*. The cylindrical portion 28*b* is partially provided with a small-diameter portion. Thus, the skirt portion 29*b* partially overlaps the small-diameter portion.

The connecting bracket 31 is adapted to integrally connect the gripping tubular body 29 with the securing shaft body 27 so as to be spaced at a given interval from each other. The connecting bracket 31 requires considerable strength. Thus, for example, steel, stainless steel or the like is suitable for use as material for the connecting bracket 31. The connecting bracket 31 is generally formed in a U-shape and provided with a shaft body side securing portion 31*a* at one end and with a tubular body side securing portion 31*b* at the other end. The shaft body side securing portion 31*a* and the tubular body side securing portion 31*b* are connected to each other by means of the connecting portion 31*c*. These components are formed integrally.

The shaft body side securing portion 31*a* of the connecting bracket 31 is secured to an end face portion of the securing shaft body 27 by means of a fixation screw 44. The tubular body side securing portion 31*b* is secured to the inner surface of the upper surface portion 29*a* of the gripping cylindrical body 29. A positioning projecting portion 46 is provided on the tubular body side securing portion 31*b*. In addition, a recessed portion 47 corresponding to the projecting portion 46 is provided on the upper surface portion 29*a*. The recessed portion 47 is aligned with the projecting portion 46, whereby the gripping tubular body 29 is positioned on the securing shaft body 27 at a predetermined position.

Figure 5:
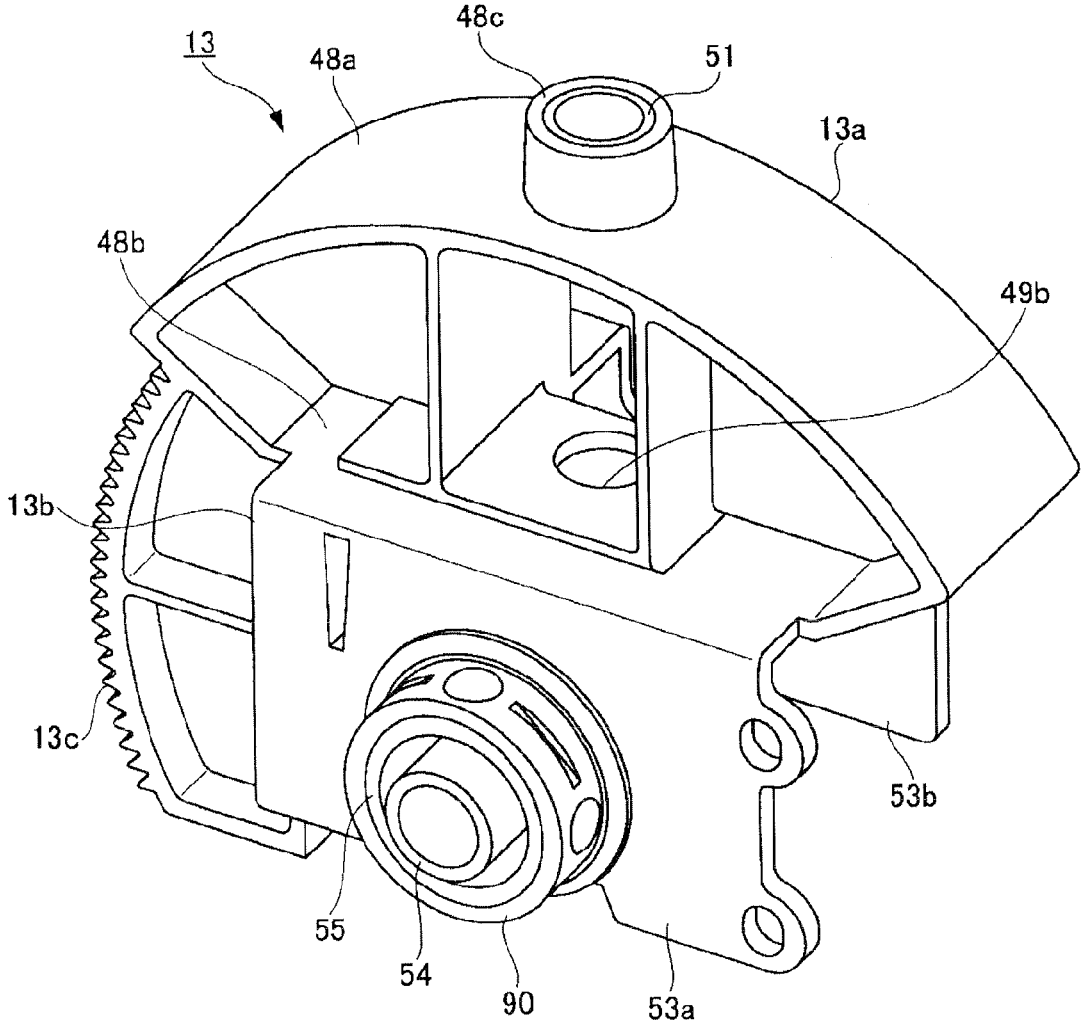
FIG. 5 is a perspective view of a holder of the joystick device according to the embodiment of the present invention.

The control lever 11 is supported axially shiftably in a predetermined range with respect to the holder 13. The holder 13 is configured as illustrated in FIG. 5. Specifically, the holder 13 includes a sectoral portion 13*a* expanded in a sector form; a housing portion 13*b* formed continuously with the lower portion of the sectoral portion 13*a*; and a gear portion 13*c* formed continuously with one side of the housing portion 13*b*. The sectoral portion 13*a* has an outer circumference curved portion 48*a* formed by being curved circularly; and an inside flat portion 48*b* opposed to the outer circumference curved portion 48*a* and serving as a chord with respect thereto. The outer circumference curved portion 48*a* is provided at its circular-directional central portion with an upper through-hole 49*a* passing vertically therethrough. Similarly, the inside flat portion 48*b* is provided at its central portion with a lower through-hole 49*b* passing vertically therethrough.

The large-diameter portion 23*a* of the outer tube 23 of the control lever 11 is slidably fitted into the lower through-hole of the inside flat portion 48*b*. The small-diameter portion 23*b* of the outer tube 23 is slidably fitted into the upper through-hole 49*a* of the outer circumference curved portion 48*a*. A boss portion 48*c* is provided on the outside of the upper through-hole 49*a* of the outer circumference curved portion 48*a*. The small-diameter portion 23*b* of the outer tube 23 is slidably inserted through the bush 51 fitted to the boss portion 48*c*. A stopper plate 52 is secured to the lower surface of the inside flat portion 48*b* by means of a securing section such as a double-stick tape, an adhesive or the like.

The housing portion 13*b* of the holder 13 includes a front piece 53*a* and a rear piece 53*b* installed to be spaced apart from each other at a predetermined gap therebetween in a direction perpendicular to the direction where the sectoral portion 13*a* extends; and a lateral piece 53*c* connecting one side of the front piece 53*a* with that of the rear piece 53*c*. The flange portion 23*c* of the outer tube 23 is disposed in a space portion surrounded by the front piece 53*a*, the rear piece 53*b* and the lateral piece 53*c*. The front piece 53*a* is provided at its generally central portion with a cylindrical tube bearing portion 54 projecting outwardly, and with a cylindrical barrel securing portion 55 concentrically disposed on the outside of the tube bearing portion 54. A pivot 56 is fitted into the hole of the tube bearing portion 54 and is secured to a first case member 101 of the case body 14 by means of a fixation screw 57.

A boss portion 58 with a bearing hole is provided at a generally central portion of the rear piece 53*b* of the housing portion 13*b* and at a position facing the tube bearing portion 54 of the front piece 53*a*. The rear piece 53*b* is provided on the upper side of the boss portion 58 with a notched portion 59 which limits the turning amount of the holder 13 in the back and forth directions. The notched portion 59 extends toward the sectoral portion 13*a* and terminates at the inside flat portion 48*b*. In addition, a second support bracket partially projects from its opening portion. The gear portion 13*c* is formed circularly with the center of the boss portion 58 taken as the center of curvature radius and is engaged with a driven gear 117 of a damper 115 described later.

Figure 8:
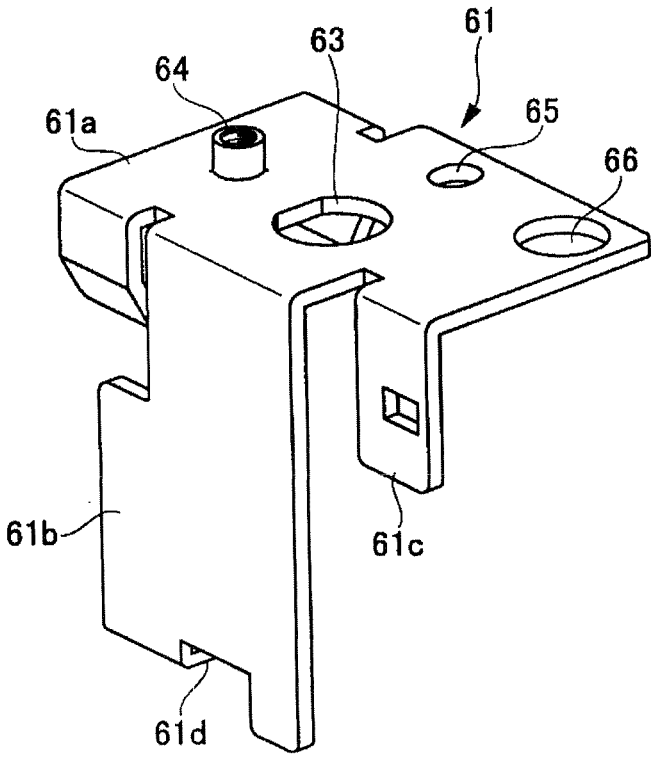
FIG. 8 is a perspective view of a first support bracket of the joystick device according to the embodiment of the present invention.

A first support bracket 61 is disposed in a space portion surrounded by the front piece 53*a* of the housing portion 13*b* of the holder 13 and the like. A second support bracket 62 is disposed between the outer circumference curved portion 48*a* and inside flat portion 48 of the sectoral portion 13*a*. The first support bracket 61 is configured as illustrated in FIG. 8. The first support bracket 61 includes an upper surface portion 61*a* opposed to the inside flat portion 48*b* of the holder 16, a lateral portion 61*b* and a switch piece 61*c*, and a bottom portion 61*d*. The lateral portion 61*b* and the switch piece 61*c* are continuously bent at 90 degrees from one side of the upper surface portion 61*a*. The bottom portion 61*d* is continuously bent at 90 degrees from the lower side of the lateral portion 61*b*.

The upper surface portion 61*a* of the first support bracket 61 is provided at its generally central portion with a through-hole 63 adapted to receive the large-diameter portion 23*a* of the outer tube 23 fitted thereinto. Further, the upper surface portion 61*a* is provided with a threaded portion 64 with which a second adjusting screw 72, illustrated in FIG. 4, threadedly engaged, with an insertion hole 65 adapted to receive a threaded shaft portion of a first adjusting screw 71 inserted therethrough, and with a through-hole 66 adapted to threadedly mount the first support bracket 61 on the holder 13. A leaf spring 69 is disposed on the outer surface of the lateral portion 61*b*. The leaf spring 69 is provided with an elastically pressing portion 69*a* which circularly projects toward the outside. The switch piece 61*c* is adapted to generate a signal turning on and off the preview switch of the television camera and is disposed on the side of the lateral portion 61*b*. The threaded portion 64 is integrally formed by press-fitting a cylindrical nut member having a threaded groove on the inner surface, into a hole provided in the upper surface portion 61*a*.

A circuit board 67 is threadedly mounted by a fixation screw 68 to the bottom portion 61*d* of the first support bracket 61. The circuit board 67 is provided with a circuit pattern formed in a predetermined shape. A variable resistor 75 indicating a specific example of a turning device is mounted on the circuit pattern. The variable resistor 75 is adapted to adjust an iris (aperture) value of the television camera. In addition, the variable resistor 75 includes a resistor housing 76 incorporating a variable resistor portion, and a turning shaft 77 projecting outwardly from one side of the resistor housing 76. The distal end portion of the turning shaft 77 is opposed to the control shaft 21 of the control lever 11 supported by the holder 13 and is connected to the control shaft 21 by means of a coupling 78 so as to be configured integrally in the turning direction and in the axial direction. The coupling 78 has two fixation screws 79*a*, 79*b*. In addition, the coupling 78 is fixedly fastened to the control shaft 21 by means of the fixation screw 79*a* and to the turning shaft 77 by means of the fixation screw 79*b*.

The first bracket 61 to which the variable resistor 75 is secured is configured integrally with the control lever 11 by tightening its upper surface portion 61*a* to the outer tube 23 by means of a lock nut 81. Specifically, the distal end side, extending from the flange portion 23*c*, of the large-diameter portion 23*a* of the outer tube 23 is inserted through the through-hole 63 of the upper surface portion 61*a*. In addition, the first support bracket 61 is secured to the outer tube 23 by tightening the lock nut 81 to the large-diameter portion 23*a* for threaded engagement. The second adjusting screw 72 is threadedly engaged with the threaded portion 64 of the upper surface portion 61*a* so as to project from the downside to the upside. The distal end of the second adjusting screw 72 is brought into contact with the stopper plate 52 secured to the lower surface of the inside flat portion 48*b* of the holder 13. The interval between the stopper plate 52 and the first bracket 61 can adjustably be increased or decreased by turning the second adjusting screw 72.

Figure 9:
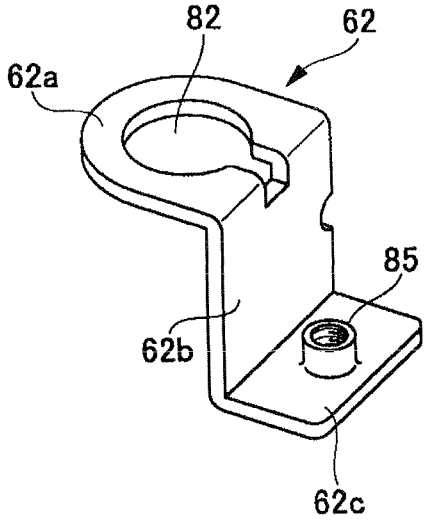
FIG. 9 is a perspective view of a second support bracket of the joystick device according to the embodiment of the present invention.

The second support bracket 62 is configured as illustrated in FIG. 9. The second support bracket 62 includes a spring-receiving piece 62*a*, a bridging piece 62*b* and a connecting piece 62*c* and is formed like a crank as a whole. The spring-receiving piece 62*a* extends vertically from one end of the bridging piece 62*b* toward one surface side. The connecting piece 62*c* extends vertically from the other end of the bridging piece 62*b* toward the other surface side. Thus, the spring-receiving piece 62*a* and the connecting piece 62*c* are formed differently in height from each other. The spring-receiving piece 62*a* is provided with a through-hole 82. A bush 83 is fitted to the through-hole 82. The large-diameter portion 23*a* of the outer tube 23 is slidably inserted through the bush 83. A coil spring 15 as a specific example of an elastic member is attached to the large-diameter portion 23*a* of the outer tube 23. One end of the coil spring 15 is brought into contact with the bush 83 and the other end is seated on the upper surface of the inside flat portion 48*b* of the holder 13. The spring-receiving piece 62*a* is biased by the spring force of the coil spring 15 in a direction where the spring-receiving piece 62*a* is away from the inside flat portion 48*b*.

The connecting piece 62*c* of the second support bracket 62 is provided with a threaded portion 85 with which the first adjusting screw 71 illustrated in FIG. 2 is threadedly engaged. The threaded portion 85 is integrally formed by press fitting a cylindrical nut member having a threaded groove on the inner surface, into a hole provided in the connecting piece 62*c*. A threaded shaft portion of the first adjusting screw 71 passing through the insertion hole 65 provided in the upper surface portion 61*a* of the second support bracket 62 is threadedly engaged with the threaded portion 85 from below. The interval between the first support bracket 61 and the second support bracket 62 can adjustably be increased or decreased by turning the first adjusting screw 71. A hexagon cap nut 86 is attached to the end of the threaded shaft portion of the first adjusting screw 71. The first adjusting screw 71, the coil spring 15, the first support bracket 61 and the second support bracket 62 constitute an axial force adjusting portion 16. In addition, the second adjusting screw 72 and the first support bracket 61 constitute a stroke adjusting portion 17.

Metal such as e.g. steel or stainless steel is suitable for use as material for the first support bracket 61 and the second support bracket 62. However, also engineering plastic such as POM, ABS or the like can be used. Engineering plastic such as e.g. POM or ABS can be applied to the material of the holder 16. However, also metal such as an aluminum alloy or the like can be used.

Referring to FIG. 4, a position detector 88 which detects the position of the control lever 11 is installed on the front piece 53*a* of the holder 13. The position detection 88 the switch piece 61*c* provided on the first support bracket 61 to detect a predetermined position in the state where the control lever 11 is depressed, and outputs such a detection signal. This detection signal turns on or off the preview switch of the television camera not shown. The position detector 88 is fixedly tightened to the front piece 53*a* by means of fixation screws 89.

Referring to FIG. 5, a barrel fixing portion 55 of the front piece 53*a* of the holder 13 is integrally provided with a torque barrel 90. The torque barrel 90 generates a frictional resistance force when the holder 16 is turned in the back and forth directions to generate an operational feeling (pressing force) according to user's preference. In addition, the torque barrel 90 is formed concentrically with the hole of the tube bearing portion 54. For example, brass is suitable for use as material for the torque barrel 90. However, other metal materials can be used obviously. The torque barrel 90 can integrally be formed by insert molding when the holder 13 is subjected to injection molding for example.

Figure 10:
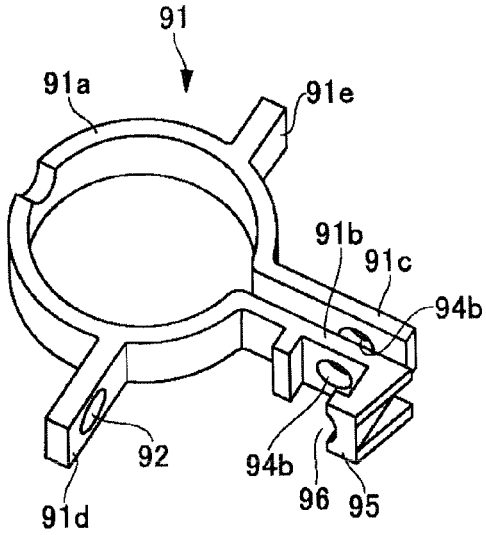
FIG. 10 is a perspective view of a torque band of the joystick device according to the embodiment of the present invention.

A torque band 91 is attached to the torque barrel 90 so as to be able to adjust a tightening force. The torque band 91 is configured as illustrated in FIG. 10. The torque band 91 includes a ring portion 91*a* formed like a ring; first and second opposing pieces 91*b*, 91*c* provided at both circumferential ends of the ring portion 91*a*; and first and second stopper pieces 91*d*, 91*e* provided at circumferentially midway portions. The ring portion 91*a* circumferentially continues to form almost a circle. The first opposing piece 91*b* extends from one end of the ring portion 91*a* toward the radially outside; the second opposing piece 91*c* extends from the other end toward the radially outside. The first stopper piece 91*d* is provided at a circumferentially midway portion of the ring portion 91*a* on the first opposing piece 91*b* side so as to project radially outwardly. The second stopper piece 91*e* is provided at a circumferentially midway portion on the second opposing piece 91*c* side so as to project radially outwardly, similarly.

Figure 3:
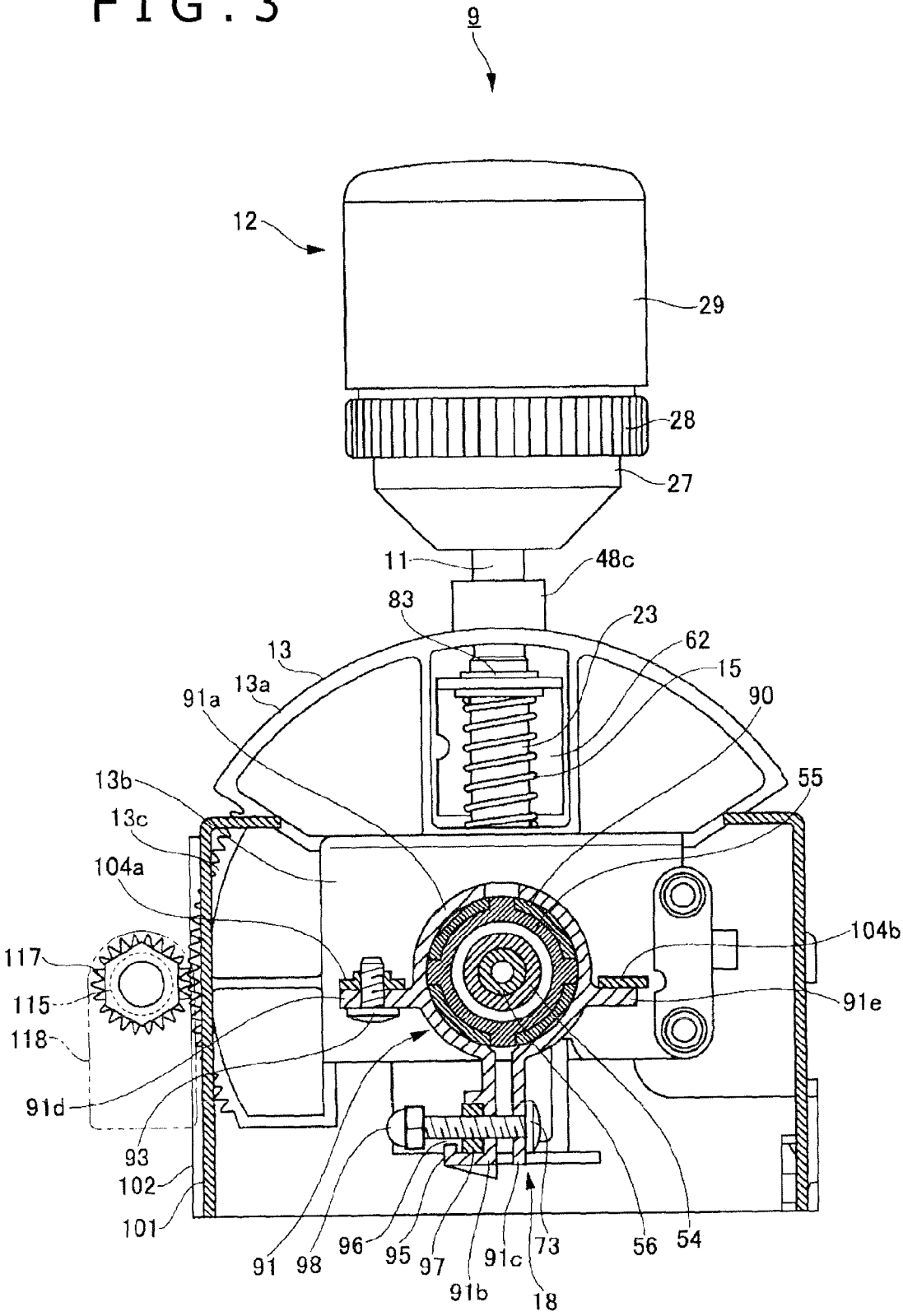
FIG. 3 is an explanatory cross-sectional view of the joystick device of FIG. 1, taken along line X-X in FIG. 2.

Referring to FIG. 3, the opposing pieces 91*b*, 91*c* of the torque band 91 are disposed under the torque barrel 90 in the state where they are assembled to the torque barrel 90. The first stopper piece 91*d* is engaged with a first engaging piece 104*a* provided on the first case member 101; the second stopper piece 91*e* is engaged with a second engaging piece 104*b* provided on the first case member 101. The first stopper piece 91*d* is provided with an insertion hole 92. The first stopper piece 91*d* is secured to the first case member 101 by means of a fixation screw 93 which is passed through the insertion hole 92 and is threadedly engaged with a threaded hole provided in the first engaging piece 104*a*.

The first opposing piece 91*b* of the torque band 91 is provided with a first through-hole 94*a* adapted to receive a third adjusting screw 73 inserted therethrough. The opposing piece 91*c* is provided with a second through-hole 94*b* adapted to receive the third adjusting screw 73 similarly inserted therethrough. Further, the first opposing piece 91*b* is provided with a nut holding portion 96 by providing an engaging claw 95. A nut 97 is held by the nut holding portion 96. A threaded shaft portion of the third adjusting screw 73 is threadedly engaged with the nut 97. A hexagonal cap nut 98 is attached to the end of the threaded shaft portion of the third adjusting screw 73 to hide the end of the threaded shaft portion. The third adjusting screw 73, the torque band 91, the torque barrel 90 and the nut 97 constitute the turning force adjusting portion 18.

The third adjusting screw 73 is turned toward the tightening side to increase the tightening force of the ring portion 91*a* against the torque barrel 90. This can increase the operating force (the frictional resistance force) encountered when the control lever 11 is turned in the back and forth directions. On the other hand, the third adjusting screw 73 is turned toward the loosening side to reduce the tightening force of the ring portion 91*a* against the torque barrel 90. This can reduce the operating force (the frictional resistance force) encountered when the control lever 11 is turned in the back and forth directions.

As described above, the holder 13 in which the control lever 11 and the like are assembled is assembled to the case body 14. The case body 14 is composed of a first case member 101 and a second case member 102.

Figure 6:
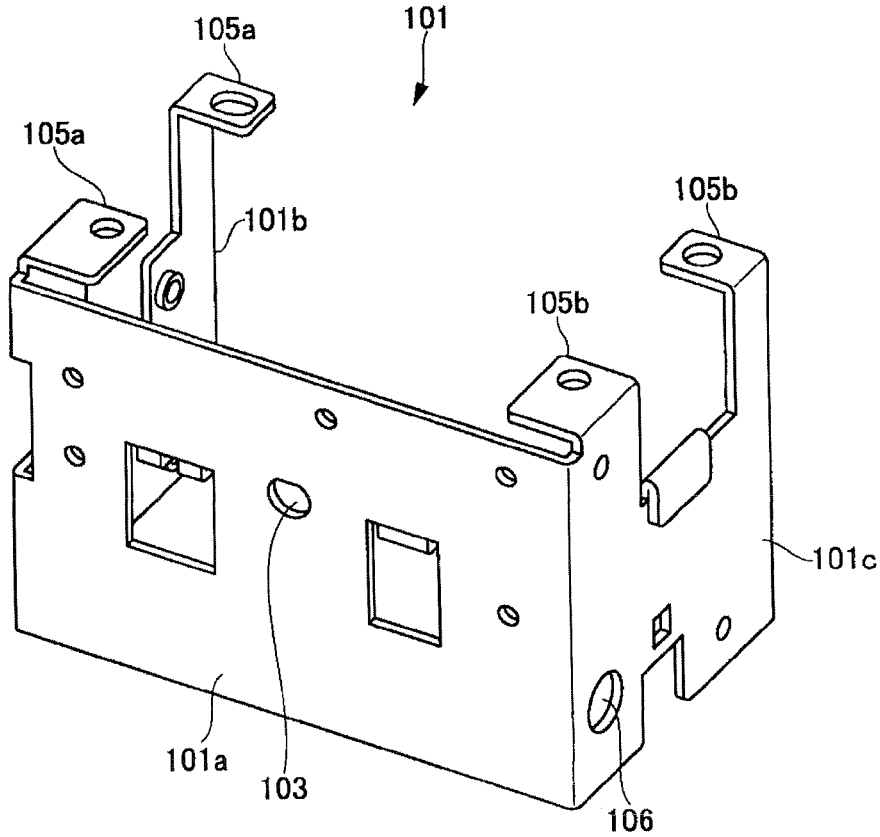
FIG. 6 is a perspective view of a first case member of the joystick device according to the embodiment of the present invention.

The first case member 101 is configured as illustrated in FIG. 6. The first case member 101 includes a front portion 101*a* formed in a horizontally long rectangle; a left lateral portion 101*b* formed continuously with the left lateral surface of the front portion 101*a*; and a right lateral portion 101*c* formed continuously with the right lateral surface of the front portion 101*a*. The front portion 101*a* is provided at a generally central portion with a fitting hole 103 adapted to receive the distal end of the pivot 56 fitted thereinto. The fixation screw 57 is threadedly engaged, from the outside, with the distal end face of the pivot 56 fitted into the fitting hole 103. In this way, the front piece 53*a* of the holder 13 is turnably supported by the first case body 101.

The two engaging pieces 104*a*, 104*b* mentioned early are formed at both lateral portions of the fitting hole 103 by partially inwardly folding the front portion 101*a*. The left and right lateral portions 101*b*, 101*c* are each provided with two attachment pieces 105*a*, 105*b* by folding back the upper end portion thereof. The right lateral portion 101*c* is provided with a working hole 106 adapted to enable adjustment work for the adjusting screw 73 from the outside of the case body 14.

Figure 7:
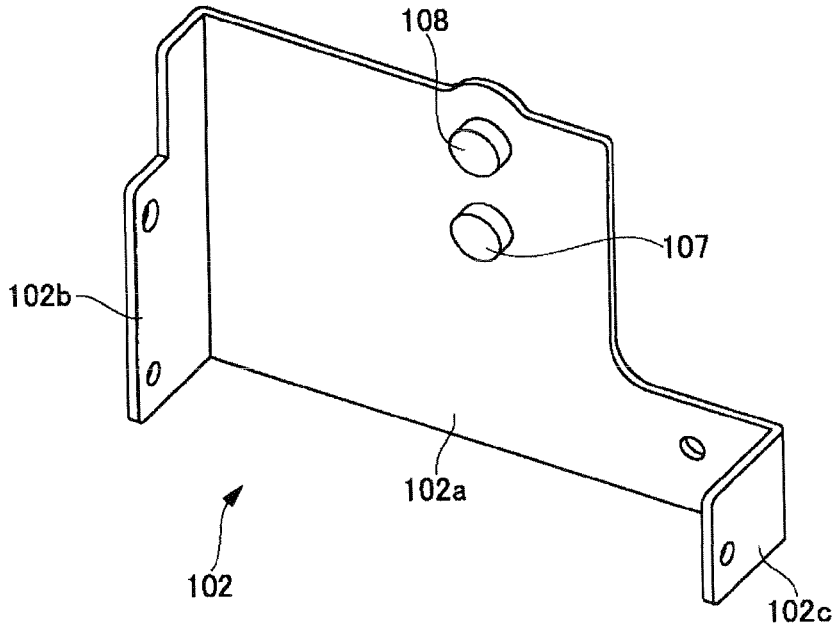
FIG. 7 is a perspective view of a second case member of the joystick device according to the embodiment of the present invention.

The second case member 102 is configured as illustrated in FIG. 7. The second case member 102 includes a back portion 102*a* formed horizontally long to correspond to the front portion 101*a* of the first case member 101, a left lateral portion 102*b* and a right lateral portion 102*c*. The left lateral portion 102*b* formed continuously with the left lateral surface of the back portion 102*a*. The right lateral portion 102*c* is formed continuously with the right lateral surface of the back portion 102*a*. A center pin 107 projecting inwardly is provided at a central portion of the back portion 101*a* and at a position corresponding to the fitting hole 103 provided in the front portion 101*a*. The axis of the center pin 107 is designed to align with the axis of the pivot 56 in the state where the first case member 101 and the second case member 102 are assembled.

A stopper pin 108 limiting the turning in back and forth angle of the holder 13 is provided on the back surface 102*a* of the second case member 102 at a position above the center pin 107. In the state where the first case member 101 and the second case member 102 are assembled, the stopper pin 108 is engaged with the notched portion 59 provided in the housing portion 13*b* of the holder 13 and the turning amount of the holder 13 is limited within the opening range of the notched portion 59. The two lateral portions 102*b* and 102*c* of the second case member 102 are configured to partially overlap the two lateral portions 101*b* and 101*c*, respectively, of the first case member 101. The overlapping portions between the lateral portions 101*b* and 102*b* and between the lateral portions 101*c* and 102*c* are screwed by means of a plurality of fixation screws 111 (see FIG. 1) in such a manner as to be attachable/detachable and assemblable.

Referring to FIGS. 3 and 4, a damper 115 absorbing part of the operating force of the control lever 11 is mounted to the case body 14 via a securing bracket 116 by means of screws. The damper 115 has a driven gear 117, which is meshed with a gear portion 13*c* of the holder 13. If the holder 13 is turned, such a turning force is transmitted from the gear portion 13*c* to the driven gear 117. The turning of the driven gear 117 operates the damper 115. The damper 115 is mounted on a circuit board 118 and electrically connected to a circuit pattern provided on the circuit board 118.

The joystick device 9 configured as described above can be assembled in the following manner for example. The bushes 24, 24 are first fitted to both the ends of the axial hole of the outer tube 23. The control shaft 21 is inserted through the bushes 24. The snap rings 25 are attached to the corresponding portions, of the outer tube 23, projecting from both the ends thereof. Next, the first support bracket 61 is fixedly fastened to the end portion of the large-diameter portion 23*a* of the outer tube 23 by means of the lock nut 81. The variable resistor 75 mounted on the circuit board 67 is disposed inside the first support bracket 61. In addition, the one end of the control shaft 21 is connected to the turning shaft 77 of the variable resistor 75 by means of the coupling 78. In this way, the control lever 11 and the variable resistor 77 are connected to each other in the state where the control shaft 21 and the turning shaft 77 are aligned with each other on the same axis.

Next, the coil spring 15 is disposed inside the sectoral portion 13*a* of the holder 13 and the spring-receiving piece 62*a* of the second bracket 62 is made to face above the coil spring 15. Then, the control lever 11 on the small-diameter portion 23*b* side of the outer tube 23 is made to face the inside of the housing portion 13*b* of the holder 13. In addition, the outer tube 23 is allowed to pass through the stopper plate 52, the inside flat portion 48 of the holder 13, the coil spring 15 and the bush 83. Further, the outer tube 23 is allowed to pass through the bush 51 of the outer circumference curved portion 48*a* and the distal portions of the control shaft 21 and of the outer tube 23 are allowed to project upward from the holder 13.

In this case, the pivot 56 is previously inserted through the hole of the tube bearing portion 54 of the front piece 53*a* of the housing portion 13*b*. In addition, the leaf spring 69 is previously attached to the first support bracket 61. With this, if the control lever 11 is inserted to a predetermined position, the elastic pressing portion 69*a* of the leaf spring 69 is brought into pressure contact with a head portion 56*a* of the pivot 56 to bias the first support bracket 61 toward the rear piece 53*b*.

Next, the first adjusting screw 71 is inserted through the insertion hole 65 provided in the upper surface portion 61*a* of the first support bracket 61 and its threaded shaft portion is threadedly engaged with the threaded portion 85 provided on the connecting piece 62*c* of the second support bracket 62. The end of the threaded shaft portion is made to project toward the outside of the threaded portion 85 and the hexagonal cap nut 86 is attached to the end of the threaded shaft portion. Subsequently, the second adjusting screw 72 is threadedly engaged with the threaded portion 64 of the upper surface portion 61*a* and the end of its threaded shaft portion is brought into contact with the stopper plate 52. Then, the position detector 88 is mounted to the holder 13. Next, the torque band 91 is attached to the torque barrel 90 secured to the holder 13. In this case, the third adjusting screw 73 and the nut 97 are previously attached to the torque band 91 and the hexagonal cap nut 98 is previously attached to the end of the threaded shaft portion of the third adjusting screw 73.

The case body 14 is assembled to the holder 13 in which the control lever 11 and the like are assembled. Specifically, the first case member 101 is allowed to face the front side of the holder 13; the second case member 102 is allowed to face the rear side. The fixation screw 57 is threadedly engaged from the outside of the first case member 101 with the pivot 56 supported by the tube bearing portion 54 of the front piece 53*a*. With this, the front piece 53*a* which is the front side of the holder 13 is turnably supported by the first case member 101. Next, the center pin 107 of the second case member 102 is fitted into the hole of the boss portion 58 provided on the rear piece 53*b* of the holder 13. At this time, the stopper pin 108 of the second case member 102 is inserted into the inside of the notched portion 59 of the holder 13. In this state, a plurality of (three in the present embodiment) fixation screws 111 are tightened to allow for the assembly of the case body 14.

Next, the control knob 12 is attached to the leading end of the control lever 11. Specifically, the securing shaft body 27 is fitted to the distal end of the outer tube 23 and fixedly tightened to the outer tube 23 by means of the fixation screw 33. Next, the stopper member 37 and the torque rubber 41 are attached to the turning tubular body 28, the axial hole 35 is inserted to the distal end of the control shaft 21 and thus the turning tubular body 28 is attached to the control shaft 21. The fixation screw 36 is tightened to secure the turning tubular body 28 to the control shaft 21. Next, the sleeve 42 is attached to the central shaft portion 28*a* of the turning tubular body 28 and supported by the connecting bracket 31. In addition, the connecting bracket 31 is fixedly tightened to the upper surface of the securing shaft body 27 by means of the fixation screw 44.

Next, the gripping tubular body 29 is put on the turning tubular body 28 and the recessed portion 47 is engaged with the projecting portion 46 of the connecting bracket 31 to position the gripping tubular portion 29. Thereafter, the fixation screw 45 is tightened to secure the gripping tubular body 29 to the connecting bracket 31. In this way, the assembly of the control knob 12 is finished and the whole assembling work is completed.

The operation of the joystick device 9 assembled as described above is as below. A description is first given of the case where the preview switch is turned on and off. The on-off operation of the preview switch is executed by pressing the control knob 12 in the axial direction. In this case, the gripping tubular body 29 receiving the pressing force is rigidly connected to the securing shaft body 27 via the connecting bracket 31. Therefore, the gripping tubular body 29 and the securing shaft body 27 are integrally shifted with respect to the input of the axially applied external force. Since the securing shaft body 27 is secured to the outer tube 23, the outer tube 23 is directly depressed against the spring force of the coil spring 15 while being guided by the bush 51 and the like.

In this case, the first support bracket 61 secured to the end of the outer tube 23 is integrally shifted; therefore, similarly the switch piece 61*c* is shifted to cross the detecting portion of the position detector 88. In this way, the pressed state of the control lever 11 is detected and the detected signal is outputted from the position detector 88. As a result, the preview switch is turned on or off.

The turning of the turning tubular body 28 can vary the resistance value of the variable resistor 75. In this case, of the control knob 12 only the turning tubular body 28 interposed between the securing shaft body 27 and the gripping tubular body 29 is made turnable and the control shaft 21 is secured to its central shaft portion 28*a* by means of the fixation screw 36. With this, the turning of the turning tubular body 28 integrally turns the control shaft 21, which similarly turns the turning shaft 77 of the variable resistor 75 connected to the control shaft via the coupling 78. This can vary the resistance value of the variable resistor 75 to vary the iris value of the television camera, which can adjust the brightness of a monitor screen.

The pressing force of the control lever 11 operatively pressed as described above can simply be adjusted by the adjustment work for the axial force adjusting portion 16. As illustrated in FIG. 2, the adjustment work is executed by turning the first adjusting screw 71 of the axial force adjusting portion 16 to vary the spring force of the coil spring 15. In this case, if the first adjusting screw 71 is turned to bring the second support bracket 62 close to the first support bracket 61, the coil spring 15 is compressed to increase its spring force. In this case, the spring force of the coil spring 15 is increased; therefore, the force needed to depress the control lever 11 is increased to make an operational feeling heavy. On the other hand, if the first adjusting screw 71 is turned to bring the second support bracket 62 away from the first support bracket 61, the coil spring 15 is elongated to reduce its spring force. In this case, the spring force of the coil spring 15 is reduced; therefore, the force needed to depress the control lever 11 is reduced to make an operational force light.

The stroke of the depressed operational lever 11 can simply be adjusted by the adjustment work for the stroke adjusting portion 17. As illustrated in FIG. 4, the adjustment work can be executed by turning the second adjusting screw 72 of the stroke adjusting portion 17 to vary the projecting amount of the second adjusting screw 72. In this case, the second adjusting screw 72 is turned to increase (lengthen) the projecting amount of the second adjusting screw 72 that projects upward from the upper surface portion 61*a* of the first support bracket 61. This causes the whole of the control lever 11 to drop, which reduces the distance to the position detector 88. In this way, the stroke is reduced in the axial direction of the control lever 11, which makes it possible for the preview switch to be turned on or off, relatively early. On the other hand, if the second adjusting screw 71 is turned to reduce (shorten) the projecting amount of the second adjusting screw 72 that projects upward from the upper surface portion 61*a*. This lifts the whole of the control lever 11 to increase the distance to the position detector 88. In this way, the stroke is increased in the axial direction of the control lever 11, which makes it possible for the preview switch to be turned on or off, relatively late.

A description is next given of the adjustment of the iris value. The adjustment of the iris value is executed by turning the control knob 12 in the back and forth directions. Specifically, the control lever 11 is laid forward, which can increase the iris value, for example, to make the monitor screen bright. The control lever 11 is laid rearward, which can reduce the iris value, for example, to make the monitor screen dim.

In this case, the turning force adapted to turn the control lever 11 in the back and forth directions can easily be adjusted by the adjustment work for the turning force adjusting portion 18. As illustrated in FIG. 3, the adjustment work can be executed by turning the third adjusting screw 73 of the turning force adjusting portion 18 to vary the tightening force of the torque band 91. In this case, the third adjusting screw 73 is turned to increase (strengthen) the tightening force of the torque band 91 against the torque barrel 90 to increase the friction force between the torque band 91 and the torque barrel 90. This increases the force needed to turn the control lever 11 in the back and forth directions to make the operational feeling heavy. On the other hand, the third adjustment force 73 is turned to reduce (weaken) the tightening force of the torque band 91 against the torque barrel 90 to reduce the frictional force between the torque band 91 and the torque barrel 90. This reduces the force needed to turn the control lever 11 in the back and forth directions to make the operational feeling light.

According to the embodiment of the present invention, all the motions of the control lever, i.e., the pressing force, stroke and back and forth turning force of the control lever 11 can be adjusted by simple work, i.e., only by turning the adjusting screws. Since the variable resistor 75 is disposed not inside the control knob but on the side of the holder 13, the assembly work can be facilitated and maintenance performance can be improved. Further, since no external force is transmitted to the variable resistor 75, it is possible to eliminate the possibility that the variable resistor 75 is broken by the external force. Since the variable resistor 75 is mounted on the circuit board, connection with the variable resistor 75 can be established by means of the connector. Thus, cumbersome soldering work can be eliminated, which can achieve an improvement in workability during the assembly. Further, the number of the parts in the grip can be reduced to lighten the weight of the grip. This can increase the torque adjustment range for the iris value adjustment.

The embodiment has been described thus far; however, the present invention is not limited to the embodiment and can be embodied in various ways not departing from the gist of the invention. The embodiment described above describes the example in which the present invention is applied to the remote controlling device for television camera using the joystick device as electronic equipment. For example, the invention can be applied to e.g., professional-use recording equipment, sound devices and other electronic equipment.

The present application contains subject matter related to that disclosed in Japanese Priority Patent Application JP 2010-077446 filed in the Japanese Patent Office on Mar. 30, 2010, the entire contents of which is hereby incorporated by reference.

What is claimed is:

1. A joystick device, comprising;

a control shaft having one end to which a control knob is attached and the other end to which a turning portion of a turning device is connected;

a holder supporting the control shaft shiftably in an axial direction of the control shaft;

a case body supporting the holder turnably around a turning shaft portion extending in a direction perpendicular to the axial direction of the control shaft;

an elastic member biasing the control shaft in the axial direction;

an axial force adjusting portion capable of adjusting a pressing force by varying a biasing force of the elastic member, the pressing force being adapted to shift the control shaft in the axial direction;

a stroke adjustment portion capable of adjusting an axially shifting stroke of the control shaft:

wherein the stroke adjustment portion has an adjusting screw threadedly engaged with first support bracket so as to have an axis parallel to the control shaft, and the stroke of the control shaft can be adjusted by turning the adjusting screw to vary an amount of projection from the first support bracket.

2. The joystick device according to claim 1, the axial force adjusting portion includes a second support bracket provided to face the first support bracket; and a second adjusting screw bringing the second support bracket close to and away from the first support bracket; and the elastic member is interposed between the second support bracket and the holder.

3. A joystick device comprising:

a control shaft having one end to which a control knob is attached and the other end to which a turning portion of a turning device is connected:

a holder supporting the control shaft shiftably in an axial direction of the control shaft;

a case body supporting the holder turnably around a turning shaft portion extending in a direction perpendicular to the axial direction of the control shaft;

an elastic member biasing the control shaft in the axial direction; and an axial force adjusting portion capable of adjusting a pressing force by varying a biasing force of the elastic member, the pressing force being adapted to shift the control shaft in the axial direction, said axial force adjusting portion including:

a first support bracket provided integrally with the control shaft;

a second support bracket provided to face the first support bracket; and, a first adjusting screw bringing the second support bracket close to and away from the first support bracket;

the elastic member being interposed between the second support bracket and the holder, and wherein the elastic member is a compressed coil spring interposed between the second support bracket and the holder, the first adjusting screw has a threaded shaft portion passed through an insertion hole provided in the first support bracket and threadedly engaged with a nut portion provided on the second support bracket, and the turning of the first adjusting screw brings the first support bracket and the second support bracket close to or away from each other to vary the biasing force of the elastic member.

4. The joystick device according to claim 1, further comprising a turning force adjusting portion capable of adjusting a turning force adapted to turn the holder;

wherein the turning force adjusting portion includes a torque barrel secured to a turning shaft portion provided on the holder, a torque band wound around the torque barrel and enabled to be secured to the case body, and a third adjusting screw capable of adjusting a tightening force of the torque band against the torque barrel.

* * * * *